United States Patent [19]

Granoff

[11] Patent Number: 4,759,650

[45] Date of Patent: Jul. 26, 1988

[54] RETRACTABLE MARKING PEN WITH TIP PROTECTION MECHANISM

[75] Inventor: Richard Granoff, Sandown, N.H.

[73] Assignee: Dennison Manufacturing Company, Framingham, Mass.

[21] Appl. No.: 12,780

[22] Filed: Feb. 9, 1987

[51] Int. Cl.[4] ..... B43K 9/00

[52] U.S. Cl. ..... 401/107; 401/108

[58] Field of Search ..... 401/107, 108

[56] References Cited

U.S. PATENT DOCUMENTS

| | | | |
|---|---|---|---|
| 3,480,370 | 11/1969 | Koeln | 401/108 X |
| 3,583,820 | 7/1971 | Koeln | 401/107 |
| 3,652,172 | 3/1972 | Zepell | 401/107 X |
| 3,709,619 | 1/1972 | Zepell | 401/108 |
| 4,269,525 | 5/1981 | Melikian | 401/108 |

FOREIGN PATENT DOCUMENTS

| | | | |
|---|---|---|---|
| 1561830 | 4/1970 | Fed. Rep. of Germany | 401/107 |
| 2752304 | 7/1978 | Fed. Rep. of Germany . | |
| 1424491 | 5/1966 | France | 401/107 |

*Primary Examiner*—Steven A. Bratlie

*Attorney, Agent, or Firm*—Barry D. Josephs

[57] ABSTRACT

A retractable marking pen having a tip guard to protect the writing tip (nib) from contact with external material when the ink cartridge to which the tip is connected is retracted into the pen casing. The tip guard is composed of a pair of guard flaps which open allowing the writing tip to pass therethrough when the pen is placed in writing mode and close over the tip when the pen is in retracted mode. The guard flaps are a pair of continuous panels which extend from the inside wall of the pen casing and are integrally molded with the casing. Each guard flap has a rear section which is essentially parallel to the pen casing wall surface and a forward section which slopes towards the axis of symmetry of the pen casing at the writing end of the pen. A major bend line in the surface of each flap separates the forward section from the rear section of the flap and forms an abutment wall. As the cartridge is pushed forward the pressure exerted by the cartridge against the abutment wall causes the guard flaps to open. Upon retraction of the ink cartridge the guard flaps automatically reclose to protect the tip.

9 Claims, 5 Drawing Sheets

RETRACTABLE MARKING PEN WITH TIP PROTECTION MECHANISM

BACKGROUND OF THE INVENTION

1. Field of the Invention

The present invention relates to tip guards for retractable writing instruments, particularly retractable marking pens.

2. Description of the Prior Art

Marking pens are presently in common use. These marking instruments commonly employ a tip (nib) in contact with a reservoir of ink contained in an ink cartridge placed within the instrument. These marking pens are often referred to as "felt tip" markers but in actuality the marking tip, i.e., the nib, is typically of plastic, felt or fiber, e.g., nylon, polyester or acrylic fiber. Such marking pens come with a tight-fitting cap to protect the ink absorbed in the marking tip from evaporating when the instrument is in non-use. Markers of this type are in common use and are readily obtainable in any stationery store.

There has been a long-standing desire to produce a marking pen having a retractable tip so that the marker pen may be placed in a shirt pocket without having to attach a protective cap. Although writing pens, such as ball point pens are commonly designed to be retractable, applicant is unaware of any retractable marking pens which are commercially available. Although several designs for retractable markers have been proposed in the prior art, these prior art designs have either proved to be too costly to manufacture for commercial acceptance or do not sufficiently prevent external material such as lint or fibers from contacting the marker tip when it is in retracted position and placed, for example, in a shirt pocket. Since the writing tip and barrel opening are small with ball point or fine tip writing pens, it has proved far easier to design an effective and economical retractable ball point or retractable fine tip pen than it has been to design an effective retractable marker.

In U.S. Pat. No. 3,583,820 a retractable writing pen is disclosed which includes a closure mechanism which protects the writing tip when the ink cartridge is in its retracted position. The writing tip is attached to the head of the ink cartridge. The writing instrument has a barrel and the ink cartridge is inserted in the barrel. The forward end of the barrel forms the writing end of the pen. A shield mechanism is located at the exposed end of the barrel. The shield has longitudinally extending fingers 18 which close upon themselves to shield the writing tip when the cartridge is in its retracted position. The extending fingers (18) which compose the head of the shield are held closed by an elastomeric band (24) which surrounds extending fingers (18). A circumferential recess (22) is provided around extending fingers (18) to receive the elastomeric band (24). As the cartridge 8 is pushed to the front of the barrel, the writing tip (40) penetrates the nose (20) of the shield and on retraction of the cartridge the nose portion (20) snaps tightly closed by the action of elastomeric band (24) around fingers (18). While the writing instrument disclosed in this reference is retractable, the barrel (4) which contains nose shield (20) is a separate element which must be separately attached to the end housing (60). Thus, the separate barrel assembly containing the shield mechanism described in this reference must be molded independently of the end housing (60) and therefore adds additional cost to the manufacture of the instrument. The shield mechanism described in this reference has the additional disadvantage that it is dependent on the elastomeric band to maintain a tight closure of the extending fingers (18) which comprises the shield. Elastomeric bands tend to stiffen with time and loose their elastomeric property, particularly when exposed to harsh environmental conditions or moisture. Additionally, the shield mechanism is intended to protect only small writing tips such as fine felt or fiber tip writing pens. The problem of protecting a larger tip head, as employed in marker pens, is far more difficult because the amount of exposed surface area of the marker tip is greater.

In U.S. Pat. No. 4,269,525 a shield mechanism is disclosed, which is intended to protect the tip of a retractable felt tip writing instrument. The shield mechanism (16), which is employed in this reference, is a small disk which is located at the head of the barrel of the writing instrument. The disk has a plurality of small slit openings (17) in the surface of the disk as shown in FIG. 4. As the felt tip (14) of the writing instrument is pushed forward, it penetrates the disk surface and pushes the individual slices of the disk surface outwardly to form an opening through which the felt tip passes. Upon retraction, the individual slices of the disk surface is intended to automatically retract to form a closed, flat surface. While the design described in this reference has the advantage of simplicity, it has a distinct disadvantage in that there are a number of slit openings in the surface of the disk. e.g., eight slit openings as shown in FIG. 4. As the felt tip 14 is pushed forward, it contacts disk shield (16) leaving residual ink on the shield. This is a disadvantage because ink tends to build up on disk shield (16) and may be transferred to lint or fabric if the pen is placed in a shirt pocket. Also, since the sliced surface of the disk shield contains so many individual slices, it is difficult to assure that each slice will return to its original position, that is its closed position, over long periods of time. Even with the best materials, the resiliency of each one of the individual slices comprising the disk surface will tend to diminish on opening and reclosure. Thus, it will not be long before the slits 17 will enlarge enough to allow external material such as lint or pocket fibers to contact the tip. This, of course, is unacceptable particularly if the writing tip is larger, for example, as in typical marker pens. Thus, while the disk shield described in this reference has the advantage of simplicity, it has a distinct disadvantage inherent in the design itself, namely that a disk surface must be sliced into a multitude of individual pieces which in turn provides less protection for the writing tip over time.

Accordingly, it is an object of the invention to provide a tip guard for retractable marking instruments and the like wherein the guard protects the marker tip from contact with lint, fabric threads and external materials when the instrument is placed in a shirt pocket or in storage. It is a related object of the invention to eliminate the need for a separate closure cap for the marking instrument.

It is an important object of the invention to provide a tip guard which is integrally molded as part of the marking instrument outer casing wherein the tip guard automatically closes over the marker tip upon retraction of the tip into the casing.

It is an object that the tip guard easily opens as the marker instrument is placed in the writing mode.

It is an important object that the tip guard exhibit properties of high resiliency and recovery to permit the guard to reclose tightly over the tip irrespective of the number of retractions and the length of time that the tip is left in the writing mode prior to retraction.

It is a further object that the tip guard, upon retraction of the marking tip, provide sufficient closure protection for the tip so that evaporation of ink therefrom is reduced when the marking instrument is in non use.

SUMMARY OF THE INVENTION

In accomplishing the foregoing and related objectives, the tip guard of the invention is designed to be integrally molded to the casing of the marking instrument. The tip guard is designed for use with retractable marking instruments, typically felt, plastic and fiber tip marking pens which also include wide tip marking pens and the like. The tip guard design of the invention enables high recovery, that is, it permits the guard to reclose tightly over the tip for at least about 3000 retractions even if the tip is left in the writing mode for long periods of time, e.g., eight hours or even longer, prior to retraction. This is believed to be a distinct advantage of the present invention not realized in prior art guard design intended for the same application.

The present tip guard design has the property that it enables easy opening of the guard as the marking tip is pushed past the guard when the marking instrument is manually placed in the writing mode.

The tip guard of the invention is composed of a pair of like flaps, each of which is integrally molded to the inside wall of the marker instrument casing. This design has the advantage of simplicity and economy, since it eliminates the need for separate components containing the tip guard which components normally would have to be separately molded and separately inserted into the instrument case. The present tip guard design, therefore, permits construction of a retractable marker composed of essentially two units, (B1) the instrument casing and (B2) the ink cartridge containing the marking tip at one end and conventional retraction mechanism at the other. Each guard flap is a single continuous panel of approximately rectangular shape which extends from the inside surface of the marker instrument casing into the body of the casing. The free edge of each guard panel terminates at a point near but inside the writing end of the marker casing at the proximal intersection with the axis of symmetry of the casing. Thus, each guard panel has a sloping portion which slopes toward the axis of symmetry of the case and terminates with the free end of each guard panel in proximal intersection with the axis of symmetry of the case near the writing end of the instrument. This represents the closed position of the guard. In this mode, the free ends of each panel almost touch one another to form a protective shield over the marker tip when the tip is in its retracted position.

There are bends on the surface of each one of the guard flaps. A major bend forms two distinct sections, a forward section and a rear section, in each one of the flaps. The forward section contains the sloping portion of the flap and terminates in a free end which is closest to the open writing end of the instrument case. The rear section of the flap is connected at its most rearward edge to the inside surface of the casing. This rear section of the flap lies essentially parallel to the inside wall surface of the casing. The surface of the rear section of each flap is displaced slightly from the inside casing wall. The rear section of each flap is connected to the inside surface of the casing by an acutely bended portion of each flap at its rearmost end, formed by integrally molding the guard flap together with the instrument casing. The major bend line which separates each flap forward section from its rear section runs perpendicular to the longitudinal edge of the guard flap and lies in a plane about perpendicular to the axis of symmetry of the case. The forward section of each guard flap slopes towards the axis of symmetry of the casing allowing the free edge of the forward section of each guard flap to proximally touch one another at the axis of symmetry of the casing. The major bend line separating the forward section from the rear section occurs at about one-third the length of each guard flap as measured from the point of attachment of each flap with the inside surface of the instrument casing. The major bend line importantly forms an abutment surface with which the ink cartridge head comes into contact as the marker is placed in the writing mode. That is, as the mode is changed from retraction mode to writing mode, the forward pressure of the cartridge head on the major bend (abutment surface) causes the guard flaps to open and allows the marker tips to pass through.

Preferably, the forward section of each guard flap is itself divided into two sections by a minor bend line located on its surface parallel to the major bend line. The minor bend line divides the forward section into a far forward section and a mid-forward section. The objective of this division is to give the far forward section a greater slope towards the axis of symmetry of the casing than the midforward section.

Applicant has determined that the present design of the marker tip guard permits the guard flaps to be easily opened while creating only very small stresses on the joint connecting the flaps to the casing inside wall. This permits extremely high "recovery" of the flap, that is, return of the flap to its closed position upon tip retraction for at least several thousands of retractions.

The present tip guard design enables easy opening of the guard flaps without causing contact between the marker tip with any portion of the guard flap, even if relatively large marker tips are employed. Thus, ink is not deposited on the guard flaps at any time. The present tip guard design accomplishes sufficiently tight closure of the guard flaps over the marker tip to prevent lint, fabric fibers or other external material from coming in contact with the marker tip and absorbing ink therefrom when the marker is in its retracted position. The enclosure of the tip guard over the marker tip is also sufficiently tight to retard ink evaporation.

DETAILED DESCRIPTION

Figure 1:
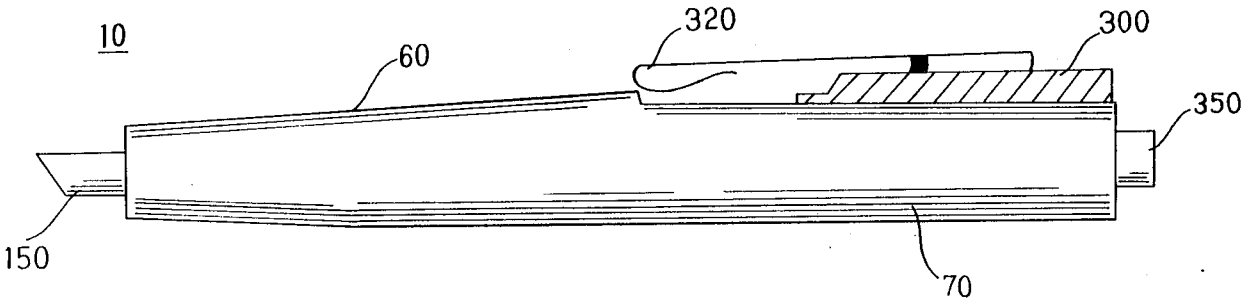
FIG. 1 is a front elevation view of the marking instrument of the invention.

A preferred embodiment of the marking instrument of the invention is shown in FIGS. 1–5. With reference to the figures, the marking instrument 10 (marking pen) is composed of a casing (12) and an ink cartridge (100). The casing (12) is largely an elongated tubular or cylindrical structure which is designed to receive ink cartridge (100). The body portion of ink cartridge (100) is a reservoir for a supply of ink. Ink cartridge 100 contains a marking tip (150) connected to the cartridge front end. The marking tip is in communication with the ink supply contained in the body of the cartridge.

Ink cartridge 100 is removably insertable into the inner chamber (15) of casing (12). Casing (12) has a tip guard (30) which is integrally molded into the front end portion of chamber 15 (FIG. 2) of casing 12. The structure of tip guard (30) of the invention is best revealed in FIGS. 2 and 3. Tip guard 30 is composed of two distinct flat portions, an upper flap (31) and a lower flap (51). The function of the tip guard flaps (31 and 51) is to protect the marking tip (150) from lint or other external material when the marking instrument 10 is in non-use. Tip guard flaps 31 and 51 are also designed to reduce evaporation of ink contained in tip 150 when the marker instrument is in non-use.

Figure 4:
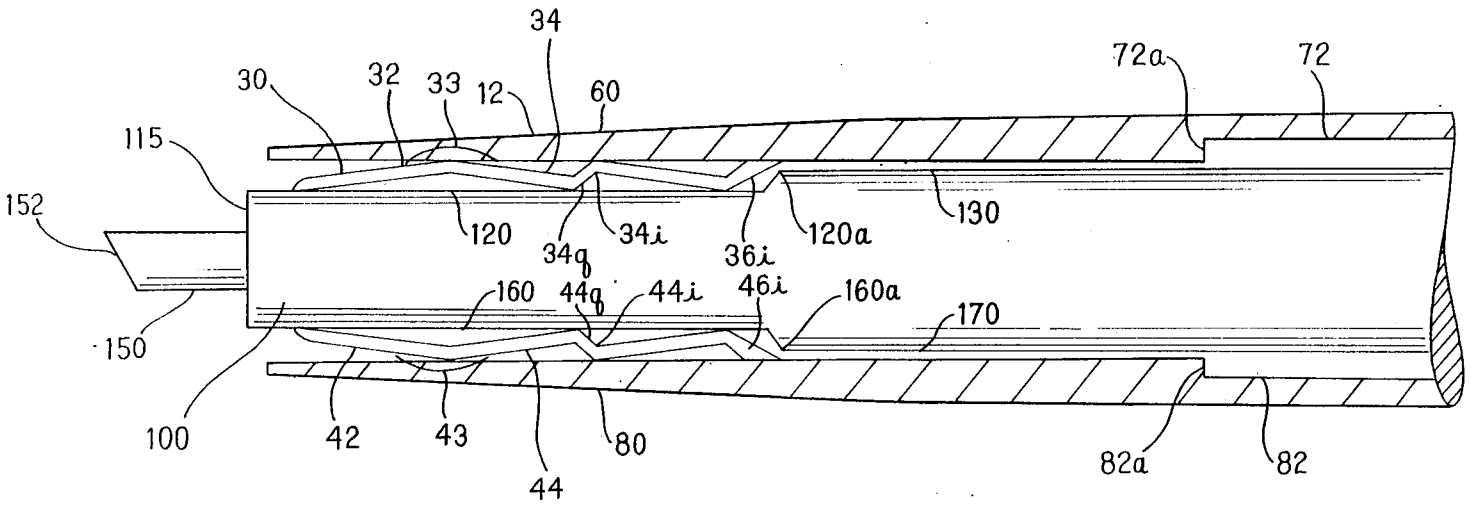
FIG. 4 is a sectional view of the forward end of the marking instrument shown in FIG. 1 with the cartridge included in the casing.

Casing 12 and ink cartridge 100 include a locking and release mechanism which functions to hold marking tip 150 in an exposed forward position when the marking instrument 10 is in use and in a retracted position when the marking instrument is in non-use. In its retracted position the cartridge 100 is designed to retract to a point within casing 12 such that the marking tip (150) is then completely covered by guard flaps 31 and 51 and no portion of marking tip 150 is exposed beyond the bounds of guard flap 31 and 51. Thus, the guard flaps 31 and 51 are designed to open and thereby separate when the marking tip 150 is in the forward position as best illustrated in FIG. 4 and guard flaps 31 and 51 are designed to close shut over marker tip 150 when cartridge 100 is retracted.

Figure 2:
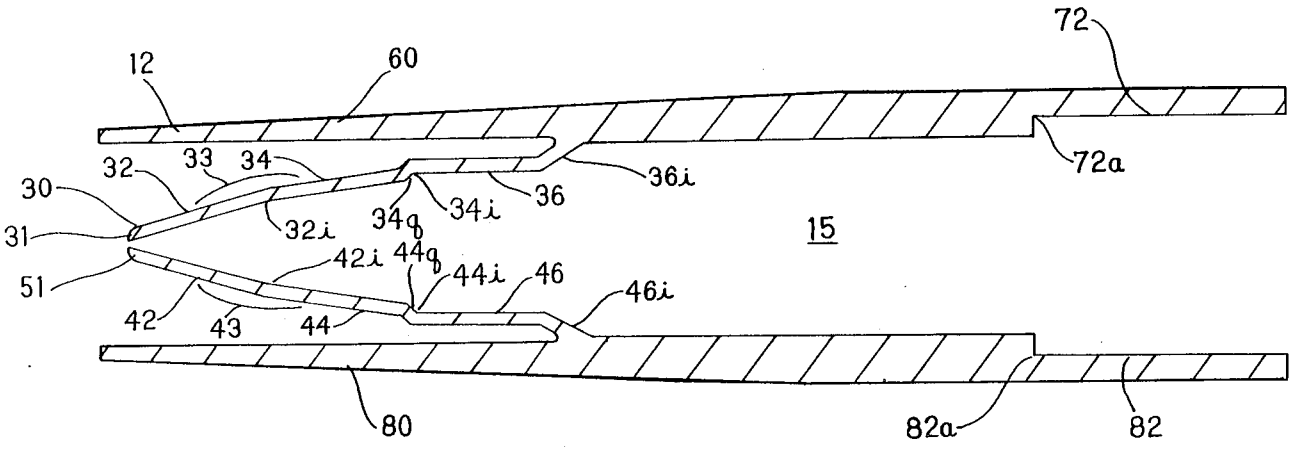
FIG. 2 is a sectional view of the casing of the marking instrument shown in FIG. 1.
Figure 3:
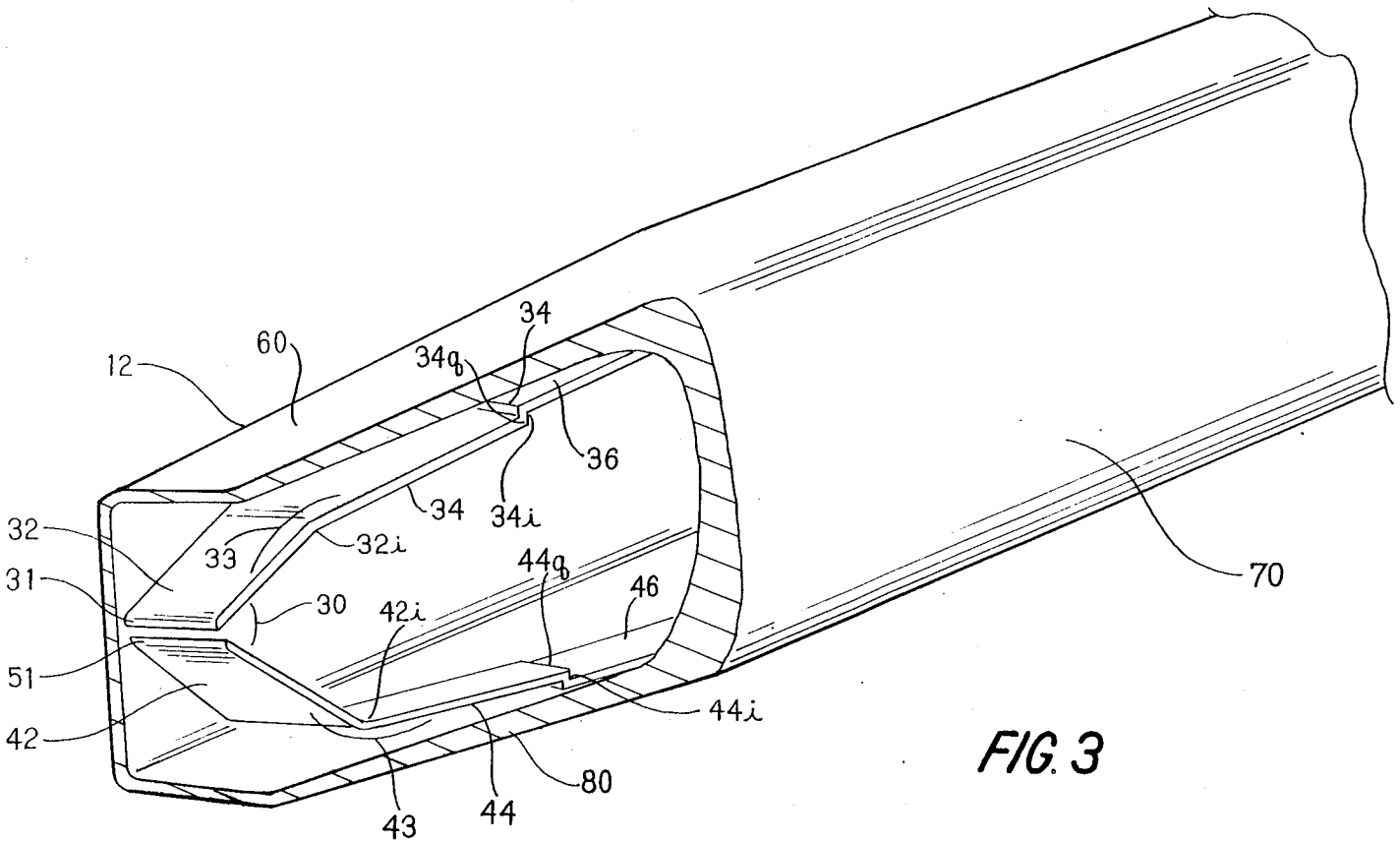
FIG. 3 is a perspective cut-away sectional view of the forward end of the casing shown in FIGS. 1 and 2.

Guard flaps 31 and 51 are of identical structure. Thus, the structure of guard flap 31 will be understood to apply equally to the structure of flap 51 by reference to corresponding elements on flap 51. Guard flaps 31 and 51 are each composed of a single panel which is integrally molded with outer body 60 of casing 12. Thus, outer body 60 and flap 31 form a single integrally molded structure forming casing 12. Flaps 31 and 51 protrude into the interior chamber 15 of casing 12 from connecting joint **36*i* and 46*i* respectively. Guard flap 31 is a single rectangular panel which has a major bend 34*i* which divides flap 31 into a forward section 33 and a rear section 36. Rear section 36 is connected to the casing 12 inside wall surface at connecting join 36*i* by integrally molding panel 31 with casing 12, e.g., by injection molding. When panel 31 is in its normal closed position as shown in FIG. 2, rear section 36 lies essentially parallel to the inside wall surface of casing 12 and is displaced somewhat from said inside wall of casing 12 for at least a major portion, preferably most, of the length of section 36 as shown in FIG. 2. Preferably guard flap 31 has a minor bend 32*i* which divides forward section 33 into a far forward section 32 and a middle section 34. Each bend 34*i* and 32*i* runs across the width of flap 31 and is perpendicular to each longitudinal edge of the panel as illustrated in FIG. 3. Flap 31 is molded to form a recess abutting surface 34*q* which faces into chamber 15 at the bend 34*i*. Similarily flap 51 is molded to form an abutting surface 44*q* facing into chamber 15 at the bend 44*i*. Flap 51 has like elements corresponding to those on flaps 31. That is, the following elements correspond: major bends 34*i* and 44*i*; minor bends 32*i* and 42*i*; forward section 33 and 43; rear section 36 and 46; far forward section 32 and 42; middle section 34 and 44 connecting joint 36*i* and 46*i*; abutting surface 34*q* and 44*q***.

Figure 5:
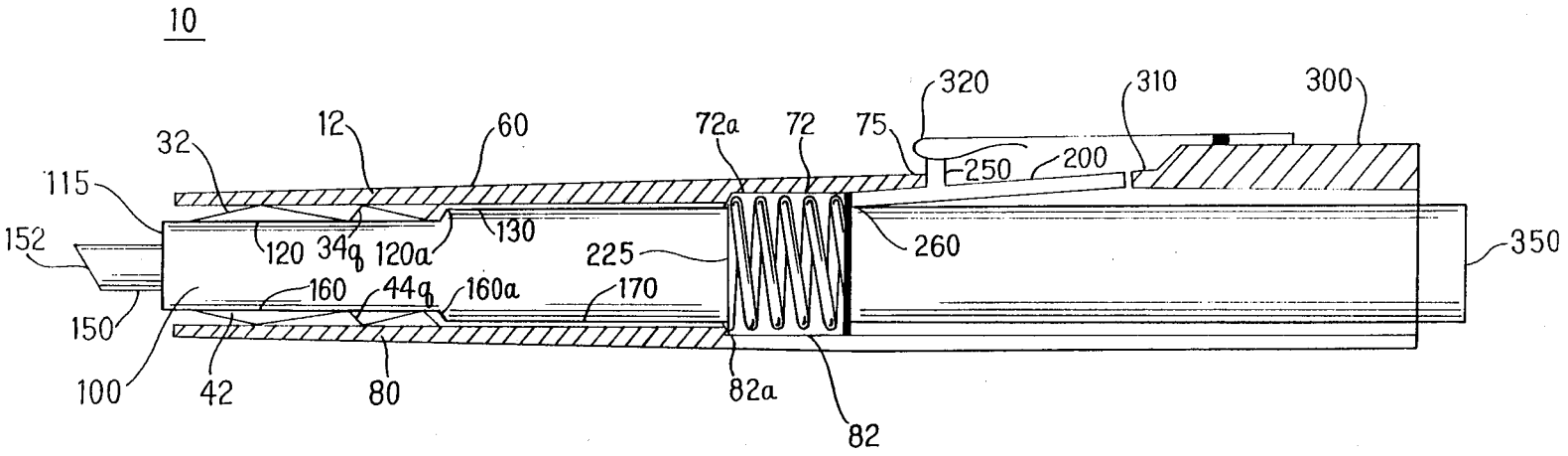
FIG. 5 is a sectional view of the complete marking instrument shown in FIG. 1 with the cartridge included in the casing.

Bends **34*i* and 32*i* on flap 31 and corresponding bends 42*i* and 44*i* on flap 51 allow guard flaps 31 and 51, respectively, to converge at a common point when the flaps are in a closed position as illustrated in FIGS. 2 and 3. When flaps 31 and 51 are in closed position, that is, when ink cartridge 100 is in the retracted mode, the front end surface 115 of ink cartridge 100, almost touches the recessed abutment surface 34*q* and 44*q* of guard flaps 31 and 51 respectively. In order to move cartridge 100 forward to expose mark tip 150 for marking or writing purposes simple finger pressure is exerted at the rear end 350 of the ink cartridge. As end 350 is pushed with only a slight force, the forward pressure of front head 115 of the ink cartridge against the abutment recessed surfaces 34*q* and 44*q* cause the guard flaps 31 and 51 to separate and allow marking tip 150 and cartridge head surface 115 to move forward past the tips of the guard flaps and protrude through the open end of casing 12 as shown in FIGS. 4 and 5**.

No portion of marking tip 150 comes into contact with either flaps 31 or 51 as cartridge 100 is pushed forward. It is important to avoid contact between marking tip 150 and the guard flaps. If contact were made, ink from the marking tip 150 would accumulate on the surface of the guard flaps 31 and 51 and thereby cause leakage of ink from the marking tip into the chamber 15 of the casing 12.

The marking tip guard flap design of the present invention exhibits a number of important properties that make it effective in carrying out all of the stated objectives. Guard flaps 31 and 51 protect marking tip 150 from contact with another external surface when the marking instrument is in the retracted mode. Thus, when the marking instrument is in the retracted mode the user may carry it in a shirt pocket without danger of leakage of ink into any fiber or thread inside of his pocket. This is accomplished without sealing the end of the marking instrument with any cap since the guard panels 31 and 51 provide enough protection when in closed position to prevent contact between the marking tip and any external material. The tip guard design of the present invention also has the property that allows opening of the guard panels 31 and 51 with only minimal forward pressure exerted on the end 350 of cartridge 100.

Importantly, the present flap guard design has been determined to have a high degree of recovery. Applicant defines "recovery" of guard panels 31 and 51 as the property of the present design which permits guard flaps 31 and 51 to return without distortion to the closure position as shown in FIG. 2 for at least about 3000 retractions of the cartridge into the casing. Recovery of guard shields to protect a marker tip, which is a larger tip than finely pointed writing pen tips, has posed difficult problems to the designer, which Applicant has overcome. In particular, the problem of recovery of the guard to its closed position, without distortion, after many retractions of the cartridge has proved to be a difficult problem. The problem of recovery, which Applicant has solved in the present tip guard design, is made all the more difficult because the marking tip is often left in the forward position, that is in the writing mode for prolonged periods of time, thereby placing prolonged stress on the guard flaps. In the present design stress on the connecting joints 36*i* and 46*i* of the guard flaps 31 and 51, when open, has proved to be insignificant and does not noticably diminish the degree of recovery over prolonged use. The aforestated high degree of recovery is attained without employing elastic bands, tension bands or the like or any other external tensioning material around guard flaps 31 and 51.

The preferred material for casing 12 and integrally molded guard flaps 31 and 51 has been determined to be an acetal copolymer resin available under the trademark CELCON acetal copolymer from the Celanese Corporation, Chatham, NJ. A preferred grade of CELCON acetal copolymer found to be very suitable for the casing 12 and integrally molded guard flaps 31 and 51 is the CELCON high flowability grade acetal copolymer. This particular grade of CELCON acetal copolymer exhibits high degree of resin flowability during the injection molding process and results in a molded material which exhibits high degree of resiliency of the molded guard flaps 31 and 51. It is preferable to carry out the injection molding of casing 12 with integrally molded guard flaps 31 and 51 employing CELCON high flowability grade acetal copolymer at a mold cast temperature of about 200° F. with a temperature of the CELCON acetal resin material in the mold at about 390° F. Additionally, Applicant has determined that the injection molding residence time with this preferred material should be about 5 to 10 seconds to obtain maximum stress release of the material during the molding, which in turn contributes to attainment of high resiliency and recovery of the molded guard flaps.

The preferred guard design as illustrated in the figures, e.g., FIGS. 2 and 3 which has been determined to accomplish all of the stated objectives, has the following preferred dimensions and tolerances. A typical casing chamber 15 of about 0.340 inches in width, an effective wall thickness for the guard flaps 31 and 51 should be about 0.020 inches at a minimum, but no thicker than about 0.025 inches. The flaps rear section 36 and 46 respectively should be about 0.280 inches in length with a tolerance of about 0.005 inches. The length of the remaining portion of the flap, that is the distance between the tip of flap 31 and major bend 34*i* should be about 0.475 inches with a tolerance of about 0.005 inches. Likewise, the distance between the tip of flap 51 and major bend 44*i* should be the same distance, that is, 0.475 inches with a tolerance of 0.005 inches. The abutting surfaces 34*q* and 44*q* can be conveniently molded with a radius of about 0.015 inches at the bend points 34*i* and 44*i* respectively. The closure angle, that is the angle that the flap 31 far forward section, namely section 32, makes with the axis of symmetry of casing 100 should be about 17° with a tolerance of about plus or minus 0.5 degrees. Similarly, the preferred closure angle that the lower flap forward section 42 makes with the axis of symmetry of casing 12 should be 17 degrees with a tolerance of about plus or minus 0.5 degrees. It will be observed from FIG. 2 that the flap rear section, that is section 36 of upper flap 31, is parallel to the axis of symmetry of the casing 100. Similarly, the flap rear section 46 of lower flap 51 is preferably parallel to the axis of symmetry of casing 12. It may also be observed from inspection of FIG. 2 that there is preferably a slight bend at 32*i* and 42*i* of the upper and lower flaps 31 and 51 respectively. The bends 32*i* and 42*i* optimize the present guard design. In the preferred design described herein, the closure gap between upper and lower flaps 31 and 51 in normal closure upon retraction of the marking tip is 0.010 inches.

Tip guard 30 composed of guard flaps 31 and 51 may be used to protect the tip (nib) of any writing or marking pen regardless of whether the writing tip is of plastic, fiber or felt material. Guard flaps 31 and 51 of the invention have greatest utility in protecting the marking tip of marking instruments as opposed to the tips of writing instruments having small fine pointed tips. Contact of lint and external material and accompanying ink leakage from the tip does not present as great a problem with fine tipped writing pens as it does with larger tips as conventionally employed in marking pens. Thus, the guard flaps 31 and 51 of the present invention has greatest utility in protecting marking tips having a width as small as 1/32 inch but preferably widths greater than about 1/16 inch, irrespective of the material of the tip. The guard flaps 31 and 51 are most advantageously employed in protecting marker tips between about 1/16 and about $\frac{3}{8}$ inches in width. Materials for marking tips are well known. Although the marking tip for marking pens are conventionally of fiber, e.g., nylon, acrylic or polyester fiber, as well as plastic or felt, the invention is not intended to be limited to any particular material for the writing tip.

Similarily the present invention is not intended to be limited to any particular ink for the marking instruments since the tip guard 30 of the invention has utility irrespective of the particular ink employed. Marker inks typically are composed of pigment dissolved in a solvent based ink vehicle. It will be appreciated that marker inks which are slow to evaporate are preferred.

The preferred guard design as described in the foregoing is intended to be applicable and accomplish all of the above stated objectives of the invention irrespective of the release mechanism employed for retraction of the ink cartridge and marker tip into the casing. There are a variety of retraction mechanisms available and in current usage to retract writing cartridges into the casing or barrel portion of the writing instrument. For completeness of description of the applicability of the guard protection flaps of the present invention, a complete design of the marking instrument which includes a retraction and push mechanism is shown in FIG. 5. The mechanism shown in FIG. 5 includes a spring 225 which is placed over ink cartridge 100 until it abuts flange 260 on the cartridge 100. A release arm 200 emanates from flange 260 as shown in FIG. 5. Release arm 200 contains a knob 250 located at its forward end. The ink cartridge 100 illustrated in FIG. 5 shows the cartridge in its extended position. To retract the cartridge, the user simply presses the external actuator bar 320 which is in contact with knob 250 of release arm 200. Actuator 320 is secured to the rear section 300 of casing 12. As actuator 320 is depressed against knob 250, release arm 200 deflects downwardly until it falls under edge 310 of the rear casing section 300. The spring loading of spring 225 then pushes the entire cartridge rearwardly until knob 250 comes to rest against edge 310. The cartridge 100 then is at rest in its retracted position. In order to extend the cartridge forward once again, the user simply presses edge 350 of the cartridge. With exertion of only slight finger pressure, the cartridge moves forward and spring 225 becomes compressed between casing abutment surfaces 72*a*, 82*a* and flange 260. When the edge of release arm 200 passes edge 310, it snaps upwardly and comes into abutting position against edge 310 thus locking the cartridge in place in its forward extended position. Also as cartridge 100 is pushed into its forward extended position, the front edge 115 of the cartridge contacts abutment surfaces 34*q* and 44*q* of the guard flaps 31 and 51. The guard flaps 31 and 51 thence open allowing cartridge 100 to pass through.

The push and release mechanism (225 and 200) which is shown in FIG. 5 is a known push-release mechanism commonly employed in releasable writing instruments. This particular mechanism is included as illustrative of a type of push-release mechanism which can be utilized with the retractable marking instrument which includes tip guard flaps 31 and 51 of the present invention. The tip guard design of the present invention is not intended to be limited to use with any particular push-release mechanism.

While the present invention has been described with reference to preferred materials which may be employed in the injection molding of the casing and integrally molded guard flaps, it should be appreciated that there are a wide variety of plastic materials which are known to be highly resilient and fully capable of being molded by injection molding. Therefore, while the material described herein has been determined to be a preferred material, it should be recognized that a person skilled in the art could find alternative materials which would be suitable substitutes. The invention, therefore, is not intended to be limited to the preferred material. It will also be appreciated that the preferred dimensions recited for the various elements of the guard flaps of the invention has been included for completeness and departure from the preferred dimensions is possible while yet employing the design concept of the invention. The invention, therefore, is not intended to be limited to any specific material nor is it intended to be limited to the specific embodiments disclosed or to specific illustrative dimensions of component elements, but rather the invention is defined by the scope of the claims and equivalents thereof.

What is claimed is:

1. A marking instrument of the type having a casing and an ink cartridge insertable in the casing and a marking tip in communication with the cartridge at the writing end of the marking instrument, the marking tip being retractable into the instrument casing when the instrument is in nonuse; the improvement comprising:

a guard for said marking tip comprising a pair of flaps each joined at one end to the inside surface of the casing and being integrally molded with the casing, each of said flaps being a single continuous panel extending from the inside wall of the casing, neither of said panels having an elastomeric band in contact with any portion of said panels, each of said continuous panels being divided by a major bend in its surface to form a forward section (33) and a rear section (36), the rear section of each of said panels lying approximately parallel to the casing inside wall surface, said forward section (33) of each panel being divided further into a far forward section (32) and a mid forward section (34) by a minor bend in the surface of the forward section so that in the normal closed position of the flaps the plane of each of the far forward section and mid forward section slopes towards the writing end of the casing and the far forward section has a greater slope towards the axis of symmetry of the casing at the writing end than does the mid forward section and in said normal closed position the mid forward section has a greater slope towards the axis of symmetry of the casing at the writing end than does the rear section; the far forward section, the mid forward section and rear section each being substantially flat, wherein said forward section of each of said panels opens as the cartridge containing the marker tip is manually pushed forward allowing the marker tip to pass therethrough without contacting any portion of said panels, and said forward section of each panel automatically returns to its normal closed position as the marker tip is retracted, the panels forming a shield around the marker tip preventing external material from contacting the marker tip when the marker tip is retracted.

2. A marking instrument as in claim 1 wherein each of said panels is joined to the inside surface of the casing at the terminal end of said rear section of each panel along the panel width and wherein each of said panels is acutely bent at said rear section terminal end to reduce mechanical stress on each of the panels as the panels open.

3. A marking instrument as in claim 1 wherein said major bend dividing each panel into a forward section and a rear section forms an abutment surface with which the cartridge end comes into contact as the cartridge is manually pushed forward, the pressure exerted by the cartridge on said abutment surface being sufficient to cause the forward section of each of the panels to open allowing the marker tip to pass therethrough without causing contact between the marker tip and any portion of said panels.

4. A marker instrument as in claim 2 wherein said major bend on each panel is placed at a distance of approximately one third the length of its respective panel as measured from the point of connection between the panel and the inside surface of the casing.

5. A marking instrument as in claim 1 wherein the far forward section and mid-forward section of each panel is of approximately equal length.

6. A marking instrument as in claim 1 wherein said far forward section of each continuous panel forms an angle of less than about 20 degrees with the axis of symmetry of the casing.

7. A marking instrument as in claim 1 wherein the far forward section of each continuous panel forms an angle of less than about 20 degrees with the axis of symmetry of the casing and the mid forward section of each continuous panel forms an angle of less than about 10 degrees with the axis of symmetry of the casing.

8. A marking instrument as in claim 1 wherein said continuous panels are comprised of an acetal resin and said panels are integrally molded with the casing by injection molding.

9. A marking instrument as in claim 1 wherein said continuous panels are of approximately rectangular shape.

* * * * *